United States Patent [19]

Hogan

[11] 3,944,128

[45] Mar. 16, 1976

[54] SHIPPING AND DISPENSING CONTAINER

[75] Inventor: Thomas E. Hogan, Waterville, Ohio

[73] Assignee: International Automated Machines, Inc., Perrysburg, Ohio

[22] Filed: Jan. 6, 1975

[21] Appl. No.: 538,791

[52] U.S. Cl. ..... 229/17 B; 221/305

[51] Int. Cl.[2] ..... B65D 5/72

[58] Field of Search ..... 229/17 B, 7; 221/305

[56] References Cited

UNITED STATES PATENTS

| | | | |
|---|---|---|---|
| 2,676,746 | 4/1954 | Kellog et al. | 229/17 B |
| 2,803,390 | 8/1957 | MacKay | 229/17 B |
| 3,161,341 | 12/1964 | Farquhar | 229/17 B |
| 3,568,911 | 3/1971 | Bebout | 229/17 B |

*Primary Examiner*—Davis T. Moorhead

*Attorney, Agent, or Firm*—Barnes, Kisselle, Raisch & Choate

[57] ABSTRACT

A shipping and dispensing container having a panel at the lower end of the container front wall adapted to be tilted outwardly to provide a dispensing trough or spout.

7 Claims, 4 Drawing Figures

SHIPPING AND DISPENSING CONTAINER

This invention relates to a shipping and dispensing container and, more particularly, to a container of the type having a wall portion separable from the adjacent wall portions of the container so that it can be tilted outwardly and form a dispensing trough or spout on the container.

The object of this invention is to provide a container of the above type which is constructed so that it can be formed from a generally rectangularly shaped blank and so that the strength thereof is maximized while the amount of material required to form the container is minimized.

Other features and objects of the present invention will become apparent from the following description and accompanying drawing, in which.

Figure 1:
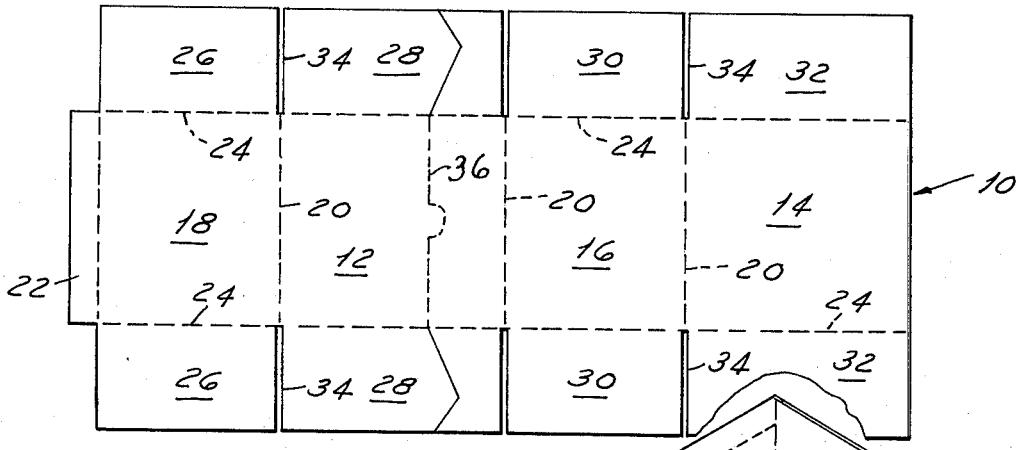
FIG. 1 is a plan view of the blank from which the container of the present invention is formed.
Figure 4:
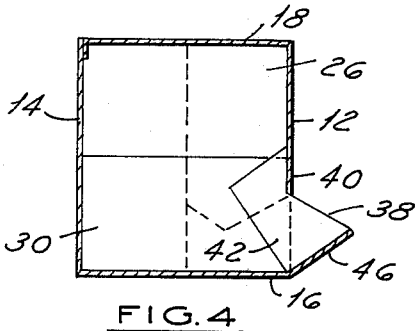
FIG. 4 is a sectional view along the line 4—4 in FIG. 3.

In FIG. 1 there is illustrated a blank, generally designated 10, from which the container of the present invention is formed. The blank has a front wall panel 12, a rear wall panel 14, a bottom wall panel 16, and a top wall panel 18. These panels are interconnected by fold lines 20. If desired, the free edge of top wall panel 18 can be provided with a short extension to form a glue panel 22. The blank is also provided with a plurality of end wall panels connected to the other walls by fold lines 24. The end wall panels connected to top wall 18 are designated 26; the end wall panels connected to front wall 12 are designated 28; the end wall panels connected to bottom wall 16 are designated 30; and the end wall panels connected to rear wall 14 are designated 32. The successive end wall panels illustrated in FIG. 1 are separated from each other by narrow notches or slits 34. It will be noted from FIG. 1 that, except for glue panel 22 (which is optional), the blank is perfectly rectangular in shape; consequently, a plurality of such blanks can be formed from paperboard sheet material with a minimum of waste.

Figure 2:
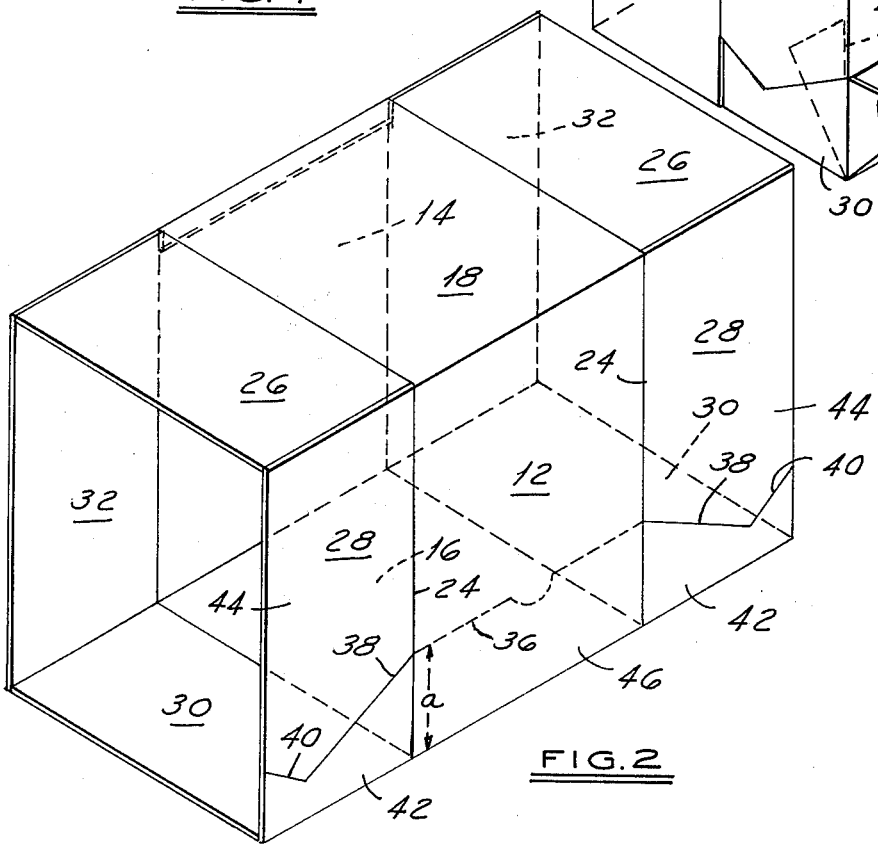
FIG. 2 shows the blank of FIG. 1 in a partially assembled condition.

In forming the container from blank 10 the walls 12, 14, 16, 18 are first folded into tubular shape as illustrated in FIG. 2 and the glue panel 22 is secured to the upper edge of rear panel 14. It will be noted from FIG. 2 that front wall 12 has a score line 36 extending horizontally thereacross below the horizontal center line of front wall 12. Each of the end wall panels 28 which are connected to the front wall 12 by the fold line 24 are severed along a line which first extends downwardly and in a rearwardly direction from the adjacent end of score line 36, as at 38, and then upwardly and rearwardly, as at 40, to the free edge of panels 28. As is illustrated, all of the end wall panels are of the same width; that is, the transverse distance between the fold lines 24 and the free edges of these panels is the same on all the end panels. It will be further noted that the dimension *a* is less than the width of the end wall panels.

Figure 3:
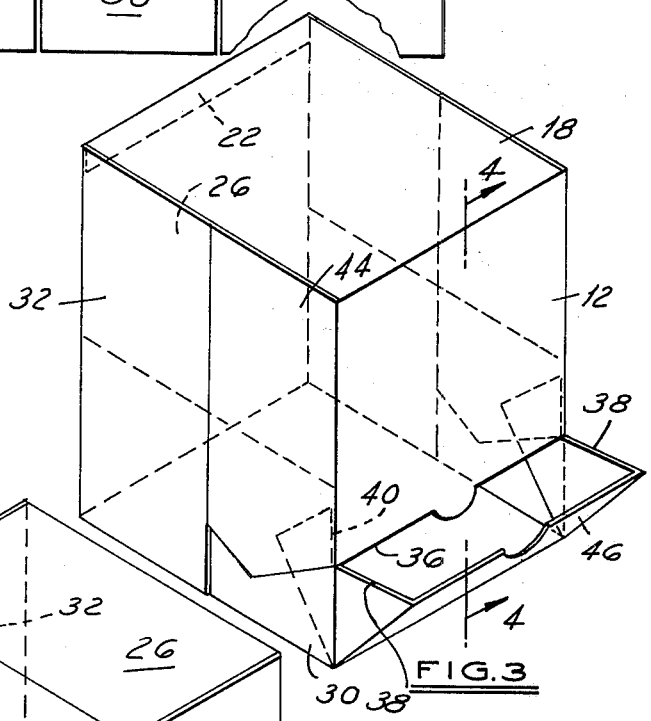
FIG. 3 is a perspective view of the container fully assembled and with the spout or trough thereon in the opened position.

In completing the assembly of the container, the portions 42 of end panels 28 below severed lines 38, 40 are first folded inwardly to a plane perpendicular to the plane of front wall 12. Then end panels 30 are folded upwardly so as to overlie the inwardly folded panel portions 42. Thereafter, end panels 26 are folded downwardly. Finally, panels 32 are folded forwardly and the portions 44 of end panels 28 above the severed lines 38, 40 are folded rearwardly. The container thus formed has the appearance illustrated in FIG. 3.

It will be noted that the width of the end wall panels is equal to one-half the dimension of the container between the front and rear walls. In the container illustrated the height is equal to twice the width of the end panels. However, this is not essential; the height of the container can be greater than twice the width of the end panels. It is preferred, however, that when the container is fully assembled the free vertical edges of end panels 32 coincide with the free vertical edges of panel portions 44 so that the panels form a completely closed container which can be readily taped along the meeting edges of these panels. In this connection it will be noted that as long as the dimension *a* is not greater than the width of the end panels, the lower ends of the panel portions 44 will overlie the end panels 30.

After the container is fully assembled as illustrated and taped or glued as desired, it can be shipped to its destination in a loaded condition. After it reaches its destination the user can sever the front wall along score line 36 and then tilt the front wall portion 46 below score line 36 outwardly. The end wall portion 42 will pivot about the lower front edge of the container until a point is reached where the severed edges 40 engage the inner face of the front wall above score line 36. When the front wall portion 46 is tilted outwardly in this manner a trough or spout is formed which permits the contents of the container to be readily dispensed.

Thus it will be seen that I have provided a shipping and dispensing container of economical and sturdy construction. By reason of the design and arrangement of the end wall panels the container is capable of sustaining substantial vertical loading. In addition, the dispensing spout or trough can have a vertical dimension as great as the width of the end wall panels without appreciably diminishing this strength of the container. The vertical dimension of the dispensing spout or trough is controlled to a large extent by the contents of the container and the desired method of dispensing; that is, manual withdrawal of the contents or tilting the container itself.

I claim:

1. A shipping and dispensing container formed of a one piece blank of generally rectangular shape and having front, rear, top and bottom walls and a pair of opposite end walls, said front, rear, top and bottom walls each consisting of a panel of single thickness hingedly connected together by fold lines at their adjacent edges, each end wall comprising four panels hingedly connected by a fold line, one with each of said top, bottom, front and rear walls, said front wall having a score line extending generally horizontally thereacross intermediate the upper and lower ends thereof, the end wall panels connected to the front wall each being severed along a line extending downwardly and rearwardly from the adjacent end of the score line on the front wall and then upwardly and rearwardly to the free edge of the last-mentioned panel, the portion of each of the last-mentioned panels below said severed line being folded inwardly perpendicular to the plane of the front wall and defining an inner surface portion of the container, the end wall panels connected to the bottom wall being folded upwardly to overlie said inwardly folded panel portions, the end wall panels connected to the top wall being folded downwardly to a plane perpendicular to the top wall and defining an inner surface portion of the container, the portion of each end wall panel connected to the front wall above said severed line being folded inwardly perpendicular to the plane of the front wall with the lower end portions thereof overlying said upwardly folded end panels and the upper portions thereof overlying said downwardly folded end panels, the end wall panels connected to the rear wall being folded forwardly to overlie the upwardly and downwardly folded end wall panels so that the container assumes the shape of a cube, means securing said walls together to retain said cubical shape, said front wall being adapted to be severed along said score line so that the portions thereof below said severed lines are substantially free so that they can be tilted outwardly to a position wherein the upwardly and rearwardly extending severed edges of said lower portions of said end panels engage the inner face of the front wall above said score line and thereby form a dispensing trough at the lower portion of said front wall.

2. A container as called for in claim 1 wherein the width of the end wall panels connected to the bottom wall is equal to at least the vertical dimension between said bottom wall and said score line.

3. A container as called for in claim 1 wherein the radial distance between the lower front corner of each end panel connected to the front wall and all points along said downwardly and rearwardly extending line of severing is not greater than the vertical dimension between said score line and the lower edge of the front wall.

4. A container as called for in claim 1 wherein all of said end wall panels are of the same width.

5. A container as called for in claim 4 wherein the height of the container is at least twice the width of the end wall panels.

6. A container as called for in claim 5 wherein the front to back dimension of the container is equal to twice the width of the end wall panels.

7. A container as called for in claim 6 wherein said score line on the front wall is disposed below the horizontally extending centerline thereof.

* * * * *